US010339877B2

(12) United States Patent
Zhang

(10) Patent No.: US 10,339,877 B2
(45) Date of Patent: Jul. 2, 2019

(54) CLOCK SIGNAL OUTPUT CIRCUIT AND LIQUID CRYSTAL DISPLAY DEVICE

(71) Applicant: Shenzhen China Star Optoelectronics Semiconductor Display Technology Co., Ltd., Shenzhen (CN)

(72) Inventor: Xianming Zhang, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 55 days.

(21) Appl. No.: 15/579,944

(22) PCT Filed: Nov. 16, 2017

(86) PCT No.: PCT/CN2017/111435
§ 371 (c)(1),
(2) Date: Dec. 6, 2017

(87) PCT Pub. No.: WO2019/015185
PCT Pub. Date: Jan. 24, 2019

(65) Prior Publication Data

US 2019/0027104 A1 Jan. 24, 2019

(30) Foreign Application Priority Data

Jul. 18, 2017 (CN) ..... 2017 1 0587340

(51) Int. Cl.
*G09G 3/36* (2006.01)

(52) U.S. Cl.
CPC ..... *G09G 3/36* (2013.01); *G09G 3/3611* (2013.01); *G09G 2310/08* (2013.01); *G09G 2330/025* (2013.01); *G09G 2330/04* (2013.01)

(58) Field of Classification Search
USPC ..... 345/208
See application file for complete search history.

(56) References Cited

U.S. PATENT DOCUMENTS 5,864,456 A * 1/1999 Connor ..... G05B 19/0425 327/380
6,583,610 B2 * 6/2003 Groom ..... H02M 3/156 323/224

(Continued)

*Primary Examiner* — Chineyere D Wills-Burns
(74) *Attorney, Agent, or Firm* — Leong C. Lei

(57) ABSTRACT

The present invention provides a clock signal output circuit and a liquid crystal display device. The clock signal output circuit comprises a clock signal conversion unit, a voltage dividing unit, a protection signal generation unit, an over-current protection unit, and a switching unit. The protection signal generating unit comprises a subtractor, a comparator, a switch, a current source, and a capacitor. When the clock signal outputted from the clock signal output circuit is used to output the clock signal to the display panel, the peak current generated after the second ON of the quickly switching the machine on/off is flown through the voltage dividing unit so that the current source could not charge the voltage at the first terminal of the capacitor to a preset protection value, and when the peak current disappears, the current source can quickly charge the voltage at the first terminal of the capacitor to the preset protection value and input to the over-current protection unit to activate the overcurrent protection function, which is capable of preventing an over-current protection falsely triggered by a peak current generated when a liquid crystal display device is quickly switched on/off.

11 Claims, 1 Drawing Sheet

(56) References Cited

U.S. PATENT DOCUMENTS

| | | | | |
|---|---|---|---|---|
| 8,810,230 | B2 * | 8/2014 | Ayukawa | H02M 1/4225 323/271 |
| 2004/0004596 | A1 * | 1/2004 | Kang | G09G 3/3406 345/102 |
| 2004/0070908 | A1 * | 4/2004 | Corcoran | G06F 1/305 361/93.1 |
| 2005/0157441 | A1 * | 7/2005 | Black | H02M 7/2176 361/100 |
| 2009/0295776 | A1 * | 12/2009 | Yu | H05B 33/0818 345/212 |
| 2011/0255319 | A1 * | 10/2011 | Ayukawa | H02M 1/4225 363/126 |
| 2014/0184959 | A1 * | 7/2014 | Zhang | H05B 33/0887 349/15 |
| 2014/0292200 | A1 * | 10/2014 | Hu | H05B 33/0887 315/119 |
| 2014/0292202 | A1 * | 10/2014 | Zhang | H05B 33/0815 315/127 |
| 2016/0286620 | A1 * | 9/2016 | Zhang | H05B 33/0815 |
| 2016/0372084 | A1 * | 12/2016 | Wang | G09G 5/18 |
| 2018/0174501 | A1 * | 6/2018 | Cao | G05F 1/10 |

* cited by examiner

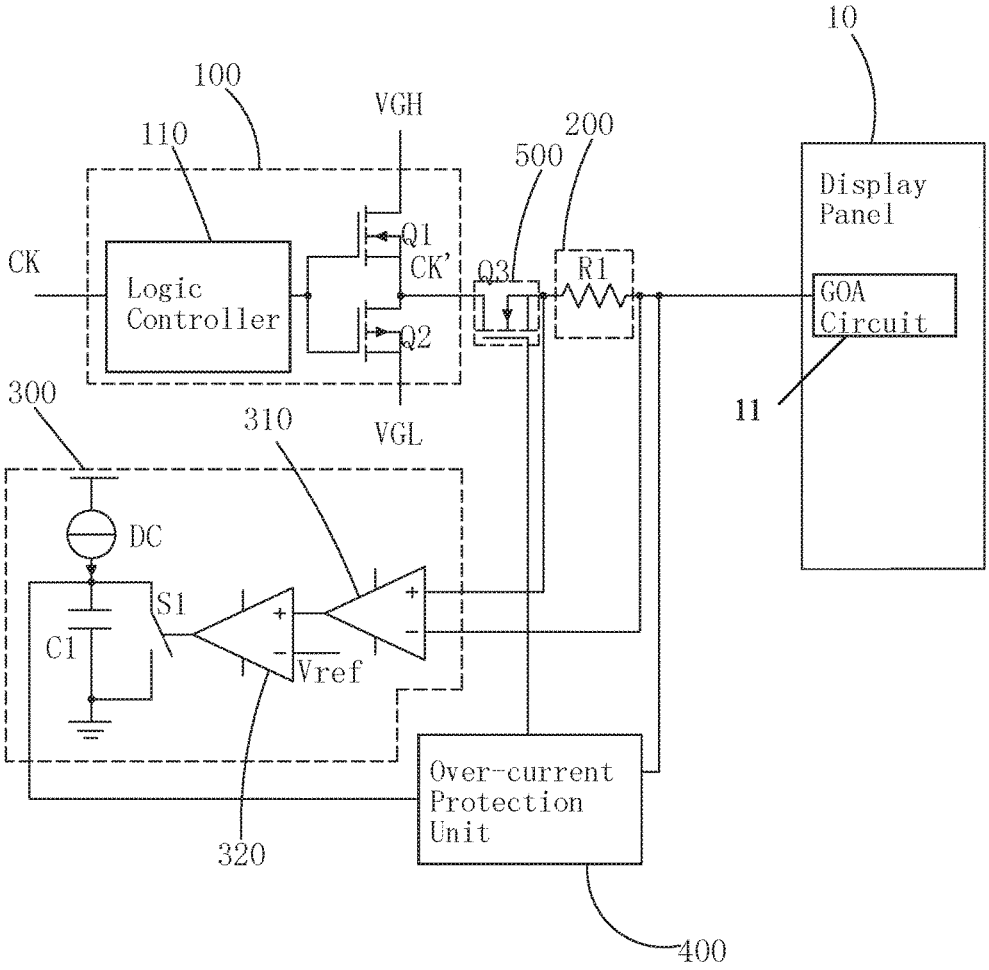
10
100
VGH
110
200
500
Display
Panel
Q1
CK
CK'
Q3
R1
Logic
Controller
GOA
Circuit
Q2
300
310
VGL
11
DC
S1
C1
Vref
Over-current
Protection
Unit
320
400

CLOCK SIGNAL OUTPUT CIRCUIT AND LIQUID CRYSTAL DISPLAY DEVICE

BACKGROUND OF THE INVENTION

Field of Invention

The present invention relates to the field of liquid crystal display, and more particularly to a clock signal output circuit and a liquid crystal display device.

Description of Prior Art

The liquid crystal display (LCD) has been widely used in various consumer electronic products such as LCD TV, mobile phones, televisions, personal digital assistants, digital cameras, computer monitor, and notebook monitor with thin body, power saving, radiation-free for wide applications, and has become the mainstream in the field of the flat display devices.

Most of the liquid crystal display devices on the market are backlight type liquid crystal displays, each of which includes a liquid crystal display panel and a backlight module. The working principle of the liquid crystal display panel is to place liquid crystal molecules between a thin film transistor array substrate (TFT array substrate) and a color filter substrate (CF substrate), and a driving voltage is applied on the two substrate for controlling the rotating direction of the liquid crystal molecules, to produce an image by refracting the light from the backlight module.

With the continuous development of the LCD display industry manufacturing technology, cost reduction is currently the industry's most important one of the development directions. Besides optimizing the process of liquid crystal display device and developing new materials for reducing production costs, putting the relevant functional modules, circuits and other integrated into the LCD panel, such as the use of array process to directly manufacture the gate scan-driving circuit on the thin film transistor array substrate (Gate Driver on Array, GOA) to replace the external gate scan-driving IC technology is also a hot content which a numerous of liquid crystal display panel manufacturers competing to develop for further reducing production costs. GOA technology can use the array process of the liquid crystal display panel to manufacture the gate driving circuit produced on the TFT array substrate, to achieve the method of cascaded gate line scanning. GOA circuit generally need to access a number of clock signals to achieve its function of cascaded gate scanning. In the conventional art, the initial clock signal is usually boosted by a level shifter and outputted to the GOA circuit of the liquid crystal display panel. Because the clock signal wirings inside the GOA and the manufacturing process, it is easy to have short circuit. In order to prevent the liquid crystal display panel from being burned out, an over-current protection (OCP) unit is set at the output of the voltage conversion unit to detect the over-current, when there is an over-current, the over-current protection unit can control the voltage conversion unit to stop outputting the clock signal, can effectively avoid melting screen caused by the short circuit of the clock signal. In the actual using process of the liquid crystal display device, due to the rapid switching machine, so that when turning on at the second time, there are a part of gate lines of the LCD panel which are not closed, at this time, it will lead to a high current to trigger the over-current protection. However, this kind of high current is a safe high current, and will not cause abnormalities of the LCD panel, that is, the over-current protection is falsely triggered.

SUMMARY OF THE INVENTION

An object of the present invention is to provide a clock signal output circuit, which is capable of preventing an over-current protection falsely triggered by a peak current generated when a liquid crystal display device is quickly switched on/off.

An object of the present invention is to provide a liquid crystal display device, which is capable of preventing an over-current protection falsely triggered by a peak current generated when a liquid crystal display device is quickly switched on/off.

In order to achieve the object, the present invention provides a clock signal output circuit, which comprises a clock signal conversion unit, a voltage dividing unit, a protection signal generation unit, an over-current protection unit, and a switching unit.

An input terminal of the clock signal conversion unit is connected with an initial clock signal and an output terminal of the clock signal conversion unit is electrically connected with a first terminal of the switching unit and outputting a converted clock signal. A first terminal of the voltage dividing unit is electrically connected with a second terminal of the switching unit and a second terminal of the voltage dividing unit is electrically connected with a display panel. The protection signal generating unit comprises a subtractor, a comparator, a switch, a current source, and a capacitor. A non-inverting input terminal and an inverting input terminal of the subtractor are respectively electrically connected with the first terminal and the second terminal of the voltage dividing unit, an output terminal of the subtractor is electrically connected with a non-inverting input terminal of the comparator. An inverting input terminal of the comparator is connected with a reference voltage and an output terminal of the comparator is electrically connected with a control terminal of the switch. The first terminal and the second terminal of the switch are respectively electrically connected with a first terminal and a second terminal of the capacitor, and the switch is closed when the control terminal of the switch is at a high level and is disconnected when the control terminal of the switch is at a low level. The first terminal of the capacitor is connected with a first terminal of the current source and the second terminal of the capacitor is grounded. The first input terminal of the over-current protection unit is electrically connected with the first terminal of the capacitor and the second input terminal of the over-current protection unit is electrically connected with the first terminal or the second terminal of the voltage dividing unit, an output terminal of the over-current protection unit is electrically connected with a control terminal of the switching unit.

The over-current protection unit is used for generating a corresponding control signal to control the switching unit to cut off, when a voltage at the first input terminal of the over-current protection unit is larger than or equal to a preset protection value and a current at the second input terminal of the over-current protection unit is larger than a preset current and keeping the same for a predetermined time.

The clock signal conversion unit comprises a logic controller, a first field effect transistor and a second field effect transistor. An input terminal of the logic controller is the input terminal of the clock signal conversion unit, an output terminal of the logic controller is electrically connected with a gate electrode of the first field effect transistor and a gate electrode of the second field effect transistor. A drain electrode of the first field effect transistor is connected with a constant high voltage and a source electrode of the first field effect transistor is electrically connected with a drain electrode of the second field effect transistor and is the output terminal of the clock signal conversion unit. A source electrode of the second field effect transistor is connected with the constant low voltage.

The logic controller is controlled to turn on or off the first field effect transistor and the second field effect transistor based on the initial clock signal, so that the output terminal of the clock signal conversion unit outputs the converted clock signal.

The first field effect transistor is an N-type field effect transistor and the second field effect transistor is a P-type field effect transistor.

The voltage dividing unit is a resistor.

The clock signal conversion unit and the protection signal generation unit are disposed on a same voltage conversion chip.

The display panel comprises a GOA circuit. The second terminal of the voltage dividing unit is electrically connected with the GOA circuit of the display panel.

The switching unit is a third field effect transistor. A gate electrode of the third field effect transistor is the control terminal of the switching unit, a drain electrode of the third field effect transistor is the first terminal of the switching unit, and a source electrode of the third field effect transistor is the second terminal of the switching unit.

The present invention further provides a liquid crystal display device, which comprises the above clock signal output circuit.

The present invention further provides a clock signal output circuit, which comprises a clock signal conversion unit, a voltage dividing unit, a protection signal generation unit, an over-current protection unit, and a switching unit.

An input terminal of the clock signal conversion unit is connected with an initial clock signal and an output terminal of the clock signal conversion unit is electrically connected with a first terminal of the switching unit and outputting a converted clock signal. A first terminal of the voltage dividing unit is electrically connected with a second terminal of the switching unit and a second terminal of the voltage dividing unit is electrically connected with a display panel. The protection signal generating unit comprises a subtractor, a comparator, a switch, a current source, and a capacitor. A non-inverting input terminal and an inverting input terminal of the subtractor are respectively electrically connected with the first terminal and the second terminal of the voltage dividing unit, an output terminal of the subtractor is electrically connected with a non-inverting input terminal of the comparator. An inverting input terminal of the comparator is connected with a reference voltage and an output terminal of the comparator is electrically connected with a control terminal of the switch. The first terminal and the second terminal of the switch are respectively electrically connected with a first terminal and a second terminal of the capacitor, and the switch is closed when the control terminal of the switch is at a high level and is disconnected when the control terminal of the switch is at a low level. The first terminal of the capacitor is connected with a first terminal of the current source and the second terminal of the capacitor is grounded. The first input terminal of the over-current protection unit is electrically connected with the first terminal of the capacitor and the second input terminal of the over-current protection unit is electrically connected with the first terminal or the second terminal of the voltage dividing unit, an output terminal of the over-current protection unit is electrically connected with a control terminal of the switching unit.

The over-current protection unit is used for generating a corresponding control signal to control the switching unit to cut off, when a voltage at the first input terminal of the over-current protection unit is larger than or equal to a preset protection value and a current at the second input terminal of the over-current protection unit is larger than a preset current and keeping the same for a predetermined time.

Wherein the clock signal conversion unit comprises a logic controller, a first field effect transistor and a second field effect transistor. An input terminal of the logic controller is the input terminal of the clock signal conversion unit, an output terminal of the logic controller is electrically connected with a gate electrode of the first field effect transistor and a gate electrode of the second field effect transistor. A drain electrode of the first field effect transistor is connected with a constant high voltage and a source electrode of the first field effect transistor is electrically connected with a drain electrode of the second field effect transistor and is the output terminal of the clock signal conversion unit. A source electrode of the second field effect transistor is connected with the constant low voltage.

The logic controller is controlled to turn on or off the first field effect transistor and the second field effect transistor based on the initial clock signal, so that the output terminal of the clock signal conversion unit outputs the converted clock signal.

Wherein the voltage dividing unit is a resistor.

Wherein the clock signal conversion unit and the protection signal generation unit are disposed on a same voltage conversion chip.

Wherein the display panel comprises a GOA circuit. The second terminal of the voltage dividing unit is electrically connected with the GOA circuit of the display panel.

The beneficial effects of the present invention are: the present invention provides a clock signal output circuit, which comprises a clock signal conversion unit, a voltage dividing unit, a protection signal generation unit, an over-current protection unit, and a switching unit. Wherein the protection signal generating unit comprises a subtractor, a comparator, a switch, a current source, and a capacitor. When the clock signal outputted from the clock signal output circuit is used to output the clock signal to the display panel, the peak current generated after the second ON of the quickly switching the machine on/off is flown through the voltage dividing unit so that the current source could not charge the voltage at the first terminal of the capacitor to a preset protection value, and when the peak current disappears, the current source can quickly charge the voltage at the first terminal of the capacitor to the preset protection value and input to the over-current protection unit to activate the overcurrent protection function, which is capable of preventing an over-current protection falsely triggered by a peak current generated when a liquid crystal display device is quickly switched on/off. The present invention is to provide a liquid crystal display device, which is capable of preventing an over-current protection falsely triggered by a peak current generated when a liquid crystal display device is quickly switched on/off.

BRIEF DESCRIPTION OF THE DRAWINGS

For further understanding of the features and technical contents of the present invention, reference should be made to the following detailed description and accompanying drawings of the present invention. However, the drawings are for reference only and are not intended to limit the present invention.

In drawings:

FIG. 1 is a circuit diagram of a clock signal output circuit according to the present invention.

DETAILED DESCRIPTION OF THE PREFERRED EMBODIMENTS

The technical means and the effects thereof will be further described with reference to the preferred embodiments of the present invention and their accompanying drawings.

Please refer to FIG. 1, the present invention provides a clock signal output circuit, which comprises a clock signal conversion unit 100, a voltage dividing unit 200, a protection signal generation unit 300, an over-current protection unit 400, and a switching unit 500.

An input terminal of the clock signal conversion unit 100 is connected with an initial clock signal CK and an output terminal of the clock signal conversion unit 100 is electrically connected with a first terminal of the switching unit 500 and outputting a converted clock signal CK'. A first terminal of the voltage dividing unit 200 is electrically connected with a second terminal of the switching unit 500 and a second terminal of the voltage dividing unit 200 is electrically connected with a display panel 10. The protection signal generating unit 300 comprises a subtractor 310, a comparator 320, a switch S1, a current source DC, and a capacitor C1. A non-inverting input terminal and an inverting input terminal of the subtractor 310 are respectively electrically connected with the first terminal and the second terminal of the voltage dividing unit 200, an output terminal of the subtractor 310 is electrically connected with a non-inverting input terminal of the comparator 320. An inverting input terminal of the comparator 320 is connected with a reference voltage Vref and an output terminal of the comparator 320 is electrically connected with a control terminal of the switch S1. The first terminal and the second terminal of the switch S1 are respectively electrically connected with a first terminal and a second terminal of the capacitor C1, and the switch S1 is closed when the control terminal of the switch S1 is at a high level and is disconnected when the control terminal of the switch S1 is at a low level. The first terminal of the capacitor C1 is connected with a first terminal of the current source DC and the second terminal of the capacitor C1 is grounded. The first input terminal of the over-current protection unit 400 is electrically connected with the first terminal of the capacitor C1 and the second input terminal of the over-current protection unit 400 is electrically connected with the first terminal or the second terminal of the voltage dividing unit 200, an output terminal of the over-current protection unit 400 is electrically connected with a control terminal of the switching unit 500.

The over-current protection unit 400 is used for generating a corresponding control signal to control the switching unit 500 to cut off, when a voltage at the first input terminal of the over-current protection unit 400 is larger than or equal to a preset protection value and a current at the second input terminal of the over-current protection unit 400 is larger than a preset current and keeping the same for a predetermined time.

Specifically, in one embodiment of the present invention, the clock signal conversion unit 100 comprises a logic controller 110, a first field effect transistor Q1 and a second field effect transistor Q2. An input terminal of the logic controller 110 is the input terminal of the clock signal conversion unit 100, an output terminal of the logic controller 110 is electrically connected with a gate electrode of the first field effect transistor Q1 and a gate electrode of the second field effect transistor Q2. A drain electrode of the first field effect transistor Q1 is connected with a constant high voltage VGH, a source electrode of the first field effect transistor Q1 is electrically connected with a drain electrode of the second field effect transistor Q2 and is the output terminal of the clock signal conversion unit 100. A source electrode of the second field effect transistor Q2 is connected with the constant low voltage VGL.

The logic controller 110 is controlled to turn on or off the first field effect transistor Q1 and the second field effect transistor Q2 based on the initial clock signal CK, so that the output terminal of the clock signal conversion unit 100 outputs the converted clock signal CK'.

Specifically, the first field effect transistor Q1 is an N-type field effect transistor and the second field effect transistor Q2 is a P-type field effect transistor.

Specifically, the voltage dividing unit 200 is a resistor R1. Of course, the voltage dividing unit 200 may be provided as a plurality of resistive in series or in parallel structures, or other elements having a voltage dividing function may be used.

Specifically, the clock signal conversion unit 100 and the protection signal generation unit 300 are disposed on a same voltage conversion chip.

Specifically, the display panel 10 comprises a GOA circuit 11. The second terminal of the voltage dividing unit 200 is electrically connected with the GOA circuit 11 of the display panel 10.

Specifically, the switching unit 500 is a third field effect transistor Q3. A gate electrode of the third field effect transistor Q3 is the control terminal of the switching unit 500, a drain electrode of the third field effect transistor Q3 is the first terminal of the switching unit 500, and a source electrode of the third field effect transistor Q3 is the second terminal of the switching unit 500.

Furthermore, the third field effect transistor Q3 can be an N-type field effect transistor or a P-type field effect transistor. When the third field effect transistor Q3 is an N-type field effect transistor, correspondingly, the over-current protection unit 400 generates a low-level control signal to control the switching unit 500 to cut off, when the voltage at the first input terminal of the over-current protection unit 400 is larger than or equal to the preset protection value and the current at the second input terminal of the over-current protection unit 400 is larger than a preset current and keeping the same for the predetermined time, or the over-current protection unit 400 generates a high-level control signal to control the switching unit 500 to turn on, when the voltage at the first input terminal of the over-current protection unit 400 is smaller than the preset protection value, or the voltage at the first input terminal of the over-current protection unit 400 is larger than or equal to the preset protection value, but the current at the second input terminal of the over-current protection unit 400 is not satisfied with being larger than the preset current and keeping the same for the predetermined time. When the third field effect transistor Q3 is a P-type field effect transistor, correspondingly, the over-current protection unit 400 generates a high-level control signal to control the switching unit 500 to cut off, when the voltage at the first input terminal of the over-current protection unit 400 is larger than or equal to the preset protection value and the current at the second input terminal of the over-current protection unit 400 is larger than a preset current and keeping the same for the predetermined time, or the over-current protection unit 400 generates a low-level control signal to control the switching unit 500 to turn on, when the voltage at the first input terminal of the over-current protection unit 400 is smaller than the preset protection value, or the voltage at the first input terminal of the over-current protection unit 400 is larger than or equal to the preset protection value, but the current at the second input terminal of the over-current protection unit 400 is not satisfied with being larger than the preset current and keeping the same for the predetermined time.

It is noted that, when the clock signal output circuit of the present invention applied to a liquid crystal display device outputs a clock signal to the display panel 10, once the liquid crystal display device is in a quickly switch on/off situation, there is a peak current flowing through the voltage dividing unit 200 after the second switch-on, and the voltage outputted from the subtractor 310 is the voltage difference across the two sides of the voltage dividing unit 200, which is positively correlated with the current flowing through the voltage dividing unit 200. Hence, with a specific selection to the reference voltage Vref, after a peak current flows through the voltage dividing unit 200, the voltage at the output terminal of the subtractor 310 (the voltage difference across the two sides of the voltage dividing unit 200) is larger than the reference voltage Vref, and the output terminal of the comparator 320 outputs a high-level voltage to the control terminal control of the switch S1 to turn off. Hence, when the peak current flows through the voltage dividing unit 200, the first terminal of the capacitor C1 is grounded to discharge the capacitor C1. With a specific setting to the preset protection value, when a peak current is occurred during the liquid crystal display device at the second switch-on, the current source could not charge the voltage at the first terminal of the capacitor C1 to the preset protection value. When the peak current disappears, with a specific selection to the reference voltage Vref, the voltage at the output terminal of the subtractor 310 is always smaller than the reference voltage Vref, i.e., the output terminal of the comparator 320 is always at a low-level voltage, the switch S1 is always turned off and the current source DC can quickly charge the voltage at the first terminal of the capacitor C1 to the preset protection value and output to the first input terminal of the over-current protection unit 400. Hence, when a current larger than the preset current flows into the second input terminal of the over-current protection unit 400 and keeps for the predetermined time, the overcurrent protection unit 400 will generates a corresponding control signal to control the switching unit 500 to be turned off, that is, and to stop the output of the clock signal to the display panel 10, and the over-current protection is achieved. The over-current protection is only performed after the peak current disappears, which is capable of preventing an over-current protection falsely triggered by a peak current generated when a liquid crystal display device is quickly switched on/off.

Based on the same inventive concept, the present invention further provides a liquid crystal display device, which comprises the above clock signal output circuit, which is capable of preventing an over-current protection falsely triggered by a peak current generated when a liquid crystal display device is quickly switched on/off. The structure of the clock signal output circuit is no longer described here.

As mentioned above, a clock signal output circuit of the present invention, which comprises a clock signal conversion unit, a voltage dividing unit, a protection signal generation unit, an over-current protection unit, and a switching unit. Wherein the protection signal generating unit comprises a subtractor, a comparator, a switch, a current source, and a capacitor. When the clock signal outputted from the clock signal output circuit is used to output the clock signal to the display panel, the peak current generated after the second ON of the quickly switching the machine on/off is flown through the voltage dividing unit so that the current source could not charge the voltage at the first terminal of the capacitor to a preset protection value, and when the peak current disappears, the current source can quickly charge the voltage at the first terminal of the capacitor to the preset protection value and input to the over-current protection unit to activate the overcurrent protection function, which is capable of preventing an over-current protection falsely triggered by a peak current generated when a liquid crystal display device is quickly switched on/off. The present invention is to provide a liquid crystal display device, which is capable of preventing an over-current protection falsely triggered by a peak current generated when a liquid crystal display device is quickly switched on/off.

As mentioned above, those of ordinary skill in the art, without departing from the spirit and scope of the present invention, can make various kinds of modifications and variations to the present invention. Therefore, all such modifications and variations are intended to be included in the protection scope of the appended claims of the present invention.

What is claimed is:

1. A clock signal output circuit, comprising a clock signal conversion unit, a voltage dividing unit, a protection signal generation unit, an over-current protection unit, and a switching unit;

an input terminal of the clock signal conversion unit being connected with an initial clock signal, an output terminal of the clock signal conversion unit being electrically connected with a first terminal of the switching unit and outputting a converted clock signal; a first terminal of the voltage dividing unit being electrically connected with a second terminal of the switching unit and a second terminal of the voltage dividing unit being electrically connected with a display panel; the protection signal generating unit comprising a subtractor, a comparator, a switch, a current source, and a capacitor; a non-inverting input terminal and an inverting input terminal of the subtractor being respectively electrically connected with the first terminal and the second terminal of the voltage dividing unit, an output terminal of the subtractor being electrically connected with a non-inverting input terminal of the comparator; an inverting input terminal of the comparator being connected with a reference voltage and an output terminal of the comparator being electrically connected with a control terminal of the switch; the first terminal and the second terminal of the switch respectively being electrically connected with a first terminal and a second terminal of the capacitor, and the switch being closed when the control terminal of the switch being at a high level and being disconnected when the control terminal of the switch being at a low level; the first terminal of the capacitor being connected with a first terminal of the current source, the second terminal of the capacitor being grounded; the first input terminal of the over-current protection unit being electrically connected with the first terminal of the capacitor and the second input terminal of the over-current protection unit being electrically connected with the first terminal or the second terminal of the voltage dividing unit, an output terminal of the over-current protection unit being electrically connected with a control terminal of the switching unit;

the over-current protection unit being used for generating a corresponding control signal to control the switching unit to cut off, when a voltage at the first input terminal of the over-current protection unit being larger than or equal to a preset protection value and a current at the second input terminal of the over-current protection unit being larger than a preset current and keeping the same for a predetermined time.

2. The clock signal output circuit according to claim 1, wherein the clock signal conversion unit comprises a logic controller, a first field effect transistor and a second field effect transistor; an input terminal of the logic controller is the input terminal of the clock signal conversion unit, an output terminal of the logic controller is electrically connected with a gate electrode of the first field effect transistor and a gate electrode of the second field effect transistor; a drain electrode of the first field effect transistor is connected with a constant high voltage, a source electrode of the first field effect transistor is electrically connected with a drain electrode of the second field effect transistor and is the output terminal of the clock signal conversion unit; a source electrode of the second field effect transistor is connected with the constant low voltage;

the logic controller is controlled to turn on or off the first field effect transistor and the second field effect transistor based on the initial clock signal, so that the output terminal of the clock signal conversion unit outputs the converted clock signal.

3. The clock signal output circuit according to claim 2, wherein the first field effect transistor is an N-type field effect transistor and the second field effect transistor is a P-type field effect transistor.

4. The clock signal output circuit according to claim 1, wherein the voltage dividing unit is a resistor.

5. The clock signal output circuit according to claim 1, wherein the clock signal conversion unit and the protection signal generation unit are disposed on a same voltage conversion chip.

6. The clock signal output circuit according to claim 1, wherein the display panel comprises a GOA circuit; the second terminal of the voltage dividing unit is electrically connected with the GOA circuit of the display panel.

7. The clock signal output circuit according to claim 1, wherein the switching unit is a third field effect transistor, a gate electrode of the third field effect transistor is the control terminal of the switching unit, a drain electrode of the third field effect transistor is the first terminal of the switching unit, and a source electrode of the third field effect transistor is the second terminal of the switching unit.

8. A liquid crystal display device, comprising the clock signal output circuit according to claim 1.

9. A clock signal output circuit, comprising a clock signal conversion unit, a voltage dividing unit, a protection signal generation unit, an over-current protection unit, and a switching unit;

an input terminal of the clock signal conversion unit being connected with an initial clock signal, an output terminal of the clock signal conversion unit being electrically connected with a first terminal of the switching unit and outputting a converted clock signal; a first terminal of the voltage dividing unit being electrically connected with a second terminal of the switching unit and a second terminal of the voltage dividing unit being electrically connected with a display panel; the protection signal generating unit comprising a subtractor, a comparator, a switch, a current source, and a capacitor; a non-inverting input terminal and an inverting input terminal of the subtractor being respectively electrically connected with the first terminal and the second terminal of the voltage dividing unit, an output terminal of the subtractor being electrically connected with a non-inverting input terminal of the comparator; an inverting input terminal of the comparator being connected with a reference voltage and an output terminal of the comparator being electrically connected with a control terminal of the switch; the first terminal and the second terminal of the switch respectively being electrically connected with a first terminal and a second terminal of the capacitor, and the switch being closed when the control terminal of the switch being at a high level and being disconnected when the control terminal of the switch being at a low level; the first terminal of the capacitor being connected with a first terminal of the current source, the second terminal of the capacitor being grounded; the first input terminal of the over-current protection unit being electrically connected with the first terminal of the capacitor and the second input terminal of the over-current protection unit being electrically connected with the first terminal or the second terminal of the voltage dividing unit, an output terminal of the over-current protection unit being electrically connected with a control terminal of the switching unit;

the over-current protection unit being used for generating a corresponding control signal to control the switching unit to cut off, when a voltage at the first input terminal of the over-current protection unit being larger than or equal to a preset protection value and a current at the second input terminal of the over-current protection unit being larger than a preset current and keeping the same for a predetermined time;

wherein the clock signal conversion unit comprises a logic controller, a first field effect transistor and a second field effect transistor; an input terminal of the logic controller is the input terminal of the clock signal conversion unit, an output terminal of the logic controller is electrically connected with a gate electrode of the first field effect transistor and a gate electrode of the second field effect transistor; a drain electrode of the first field effect transistor is connected with a constant high voltage, a source electrode of the first field effect transistor is electrically connected with a drain electrode of the second field effect transistor and is the output terminal of the clock signal conversion unit; a source electrode of the second field effect transistor is connected with the constant low voltage;

the logic controller is controlled to turn on or off the first field effect transistor and the second field effect transistor based on the initial clock signal, so that the output terminal of the clock signal conversion unit outputs the converted clock signal;

wherein the voltage dividing unit is a resistor;

wherein the clock signal conversion unit and the protection signal generation unit are disposed on a same voltage conversion chip;

wherein the display panel comprises a GOA circuit; the second terminal of the voltage dividing unit is electrically connected with the GOA circuit of the display panel.

10. The clock signal output circuit according to claim 9, wherein the first field effect transistor is an N-type field effect transistor and the second field effect transistor is a P-type field effect transistor.

11. The clock signal output circuit according to claim 9, wherein the switching unit is a third field effect transistor, a gate electrode of the third field effect transistor is the control terminal of the switching unit, a drain electrode of the third field effect transistor is the first terminal of the switching unit, and a source electrode of the third field effect transistor is the second terminal of the switching unit.

* * * * *